United States Patent [19]

Shioya et al.

[11] Patent Number: 4,899,630

[45] Date of Patent: Feb. 13, 1990

[54] SHEET SLITTING APPARATUS

[75] Inventors: Tetsuo Shioya, Tokyo; Katsuhiro Kitano, Hyogo, both of Japan

[73] Assignee: Efuesukei Kabushiki Kaisha, Tokyo, Japan

[21] Appl. No.: 343,651

[22] Filed: Apr. 27, 1989

[30] Foreign Application Priority Data

Jun. 6, 1988 [JP] Japan ..... 137250

[51] Int. Cl.[4] ..... B26D 1/24

[52] U.S. Cl. ..... 83/425.4; 83/504; 83/508.3; 83/522.11

[58] Field of Search ..... 83/482, 399, 425, 433, 83/499, 500, 508.3, 522, 425.4, 430

[56] References Cited

U.S. PATENT DOCUMENTS

| | | | |
|---|---|---|---|
| 4,224,847 | 9/1980 | Tokuno | 83/71 |
| 4,232,577 | 11/1980 | Wallman | 83/496 |
| 4,269,097 | 5/1981 | Linn | 83/482 |
| 4,604,934 | 8/1986 | Elliot et al. | 83/880 |
| 4,649,782 | 3/1987 | Caragna | 83/425.4 |

FOREIGN PATENT DOCUMENTS 43-19424 8/1943 Japan .

62-50276 10/1987 Japan .

*Primary Examiner*—Douglas D. Watts
*Assistant Examiner*—Kenneth E. Peterson
*Attorney, Agent, or Firm*—Armstrong, Nikaido, Marmelstein, Kubovcik & Murray

[57] ABSTRACT

A slitting apparatus including a frame, a rotary shaft mounted on the frame, a plurality of laterally stationary circular blades secured to the rotary shaft, and a plurality of laterally movable circular blades movable in the direction along which the stationary blades are disposed and rotatable in slidable contact with the stationary blades so that a sheet passing through between the stationary blades and the movable blades is slit therewith into plural strips each having a width being adjusted by moving the movable blades. A stationary rack extends in parallel with the rotary shaft. A carrier is movable back and forth along the rack. Holders are detachably engageable with the carrier and moved along the rack by the carrier, each of the holders having a positioning rack adapted to project therefrom for meshing with the stationary rack and withdraw thereinto and a movable member for moving one of the movable blades to and withdraw the same from a position in which the movable blade slidably contacts the stationary blades.

3 Claims, 2 Drawing Sheets

SHEET SLITTING APPARATUS

DETAILED BACKGROUND OF THE INVENTION

This invention relates to a slitting apparatus for slitting a long-sized sheet, such as a film, paper and a processed sheet into a plurality of strips of any desired width accurately, using a plurality of blades.

In a conventional slitter for long-sized sheets, slitting such a sheet to any desired width is carried out by moving a plurality of blades automatically. To be more specific, the known slitters include a shaft-inserted type in which a plurality of blades are fitted over a common shaft as disclosed in, for example, Japanese Patent Application Laid-Open Publication No. 201896/1985, and another type known as a separate holder type in which a plurality of blades are attached to their respective holders, each of which is provided with an operating means for the corresponding blade.

In the above-mentioned shaft-inserted type, the intervals at which the blades may be disposed can be set smaller, so that a sheet can be slit into strips having a smaller width. However, it requires that the blades not actually being used be shifted to both end portions of the shaft. Shifting the blades in this manner takes considerable time. In addition, since the shaft is long, flexure thereof occurs during a slitting operation which can cause the blades to warp and/or be misaligned.

In the above-mentioned separate holder type, flexure of the shaft does not occur. However, each holder holding a blade must include a cylinder for swinging the blade and a motor for laterally moving the blade itself so that the holder is relatively larger-sized and, consequently, spacing between two adjacent blades has to be made larger making it difficult to slit the sheet into strips having a small width.

In both of these types of slitters, the cutting blades consist of a plurality of laterally stationary blades adapted to be rotated at preset positions and at least one laterally movable blade adapted to rotate in slidable contact with a suitable stationary blade. When the stationary blade and the movable blade are brought into slidable contact with each other, a lateral load is applied thereto, so that the movable blade shifts in some cases from a set position at which the movable blade is supposed to remain set. Since the accuracy of setting the movable blade in a predetermined position depends upon how accurately a device for moving the blade can control moving and stopping the blade, a highly accurate blade moving device is required. When such a blade moving device gets out of order, it is not easy to move and set the blade to the predetermined position.

An object of the present invention is therefore, to provide a "separate holder" type slitter arranged to enable cutting of a long-sized sheet into strips having a small width, permit the movable blade to be automatically moved to and set at the predetermined position in a short period of time and further allow the movable blade to be positioned in place even manually, thereby eliminating the above-noted inconveniences.

SUMMARY OF THE INVENTION

According to the present invention, the above-mentioned problems are solved by a slitter apparatus having a plurality of laterally stationary circular blades secured to a rotary shaft, and a plurality of laterally movable circular blades adapted to be moved in the direction along which the stationary blades are disposed, the movable blades being rotatable in slidable contact with the stationary blades so that a sheet passing through between the stationary blades and the movable blades is slit to a width which can be adjusted by laterally moving the movable blades. The apparatus further comprises: a stationary rack extending in parallel with the rotary shaft, a carrier adapted to be moved back and for along the rack, and holders which are adapted to be engaged detachably with the carrier and moved along the rack by the carrier. The holders are provided with positioning racks projecting therefrom for meshing with the stationary rack and withdrawing thereinto, and with movable members for moving the movable blades to and withdraw the same from a position at which the movable blades slidably contact the stationary blades. In this apparatus, the detachable engagement of the carrier with the holders is made by the reciprocating movement of a cylinder provided in the carrier while the projecting and withdrawing movements of the positioning racks and the movable members are made by cylinders provided in the holders. Moreover, a plurality of light-emitting elements are disposed in a line along the stationary rack. Light-receiving members for receiving the light from the light-emitting elements are provided on the holders and the carrier, so that the projecting and withdrawing operations of the holders and the positioning of the holders by the carrier can be controlled and confirmed by the light-receiving members provided respectively on the holders and the carrier.

When the movable blades are brought into sliding contact with suitable stationary blades fixedly mounted on the rotary shaft and the rotary shaft is then rotated, the stationary blades and the movable blades are rotated, and a sheet passing through between these blades is slitted into plural strips each having a width corresponding to the set intervals of the movable blades.

If the set intervals of the movable blades are changed the width to which a sheet is to be slit changes. In order to carry out such an operation, the carrier is moved forward to the location where a holder retaining the movable blade that is to be shifted is positioned, and the carrier and the holder are then engaged with each other by, for example, the rod of a cylinder on the carrier. The positioning rack of that holder engaged with the stationary rack is then withdrawn into the holder and thereby disengaged from the stationary rack. The movable member is also withdrawn into the holder to bring the movable member out of sliding contact with the fixed blade.

Then, with the carrier moved along the stationary rack to predetermined position, the holder engaged with the carrier by the cylinder is also moved simultaneously. As the positioning rack is then caused to project from the holder to mesh with the stationary rack, the holder is put in a fixed state again. Thereafter, the carrier and holder are disengaged from each other, and the movable member is projected from the inside of the holder so as to have the movable blade slidably contact another stationary blade. When it is necessary to shift a plurality of the movable blades, the operation to engage the carrier with and disengage it from the relative holders holding the movable blades and operations to cause the relative positioning racks and movable members to project from and withdraw into the holders are carried out to move the movable blades successively to their predetermined positions.

Since the holders for the movable blades are shifted by a single carrier, each of the holders need not be provided individually with a holder moving motor. This enables the holders to be reduced in size that much and consequently the movable blades to be set at smaller intervals. Each holder is set by engaging its positioning rack with the stationary rack extending in parallel with the rotary shaft of the stationary blades. Therefore, it never occurs that the holder is displaced in the direction in which the movable blade is moved. This enables the holder to remain held in an accurately set position.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENT

Figure 1:
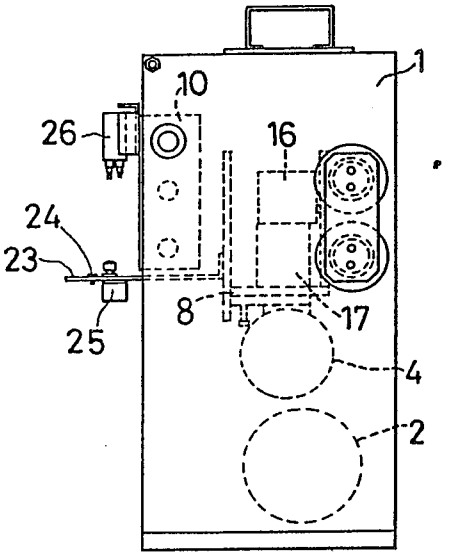
FIG. 1 is a side elevation of an embodiment of the present invention.
Figure 2:
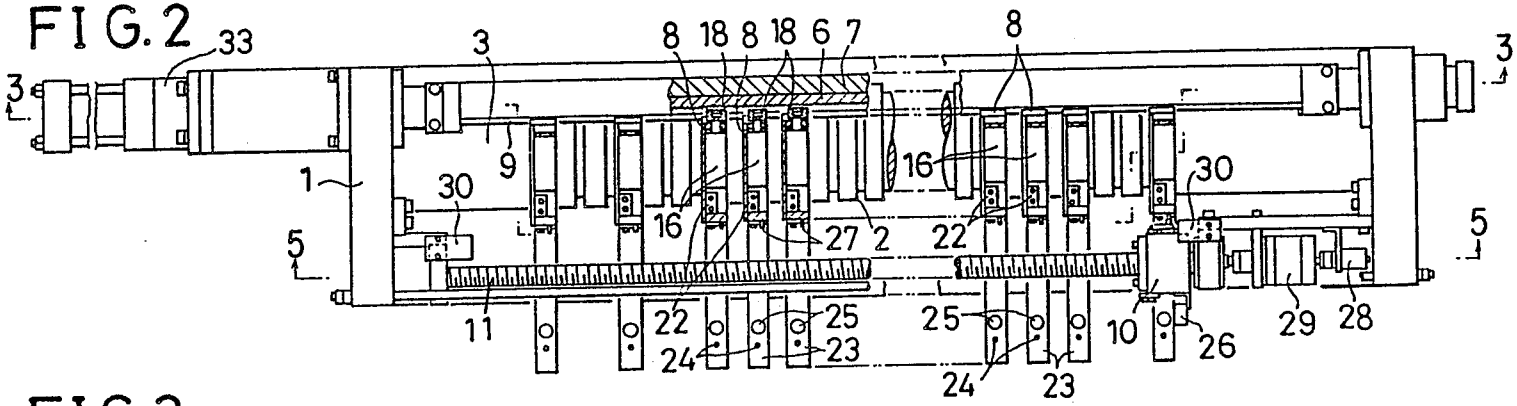
FIG. 2 is a partially sectional plan view of the embodiment of FIG. 1.
Figure 3:
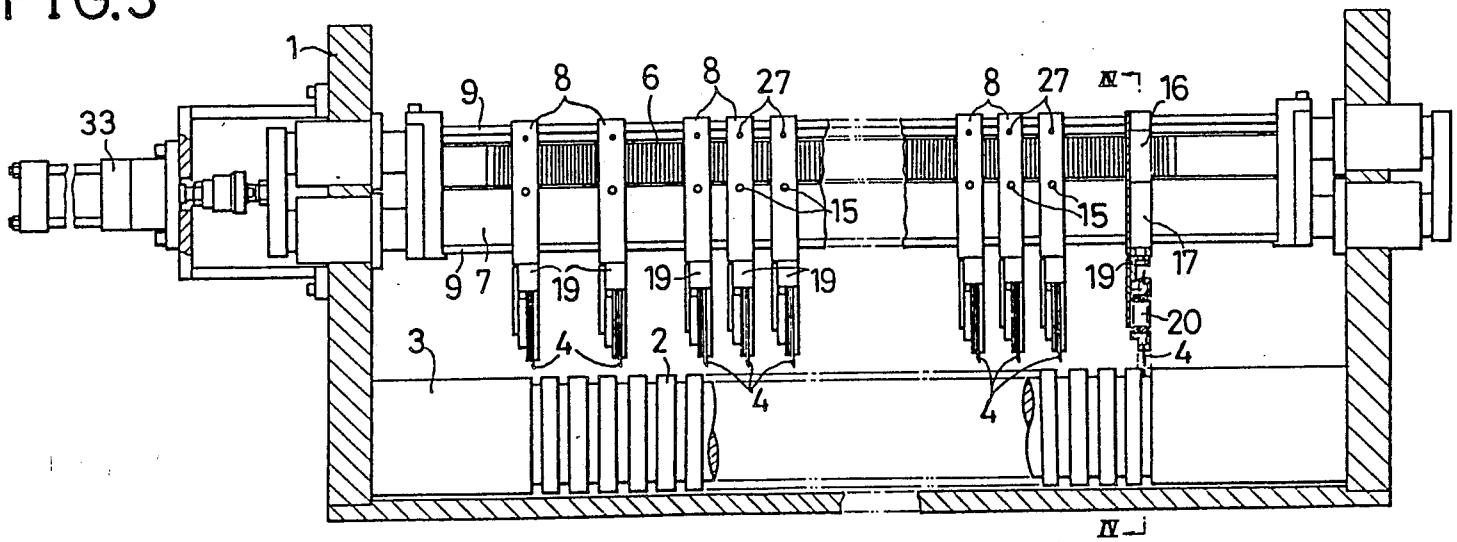
FIG. 3 is a sectional view taken along the line III—III in FIG. 2.

An embodiment of the present invention will now be described with reference to the attached drawings. Referring to FIGS. 1–3, a rotary shaft 3 is rotatably mounted on a frame 1 of the slitter. A plurality of laterally stationary circular blades 2 are fixedly mounted on the rotary shaft 3 which is adapted to be rotated by an electric motor (not shown). A plurality of laterally movable blades 4 are adapted to be moved in the direction of the arrangement of the stationary blades 2 and rotated in sliding contact with the stationary blades 2. When the stationary blades 2 and the movable blades 4 are rotated, an elongated sheet 5 passing through therebetween is slit in the lengthwise direction of the sheet into a plurality of strips each having a width corresponding to a pitch at which two neighboring movable blades 4 are spaced from each other. For example, two hundred fifty stationary blades 2 are mounted at intervals of 5 mm on the rotary shaft 3 over the substantially whole length thereof. For example, twenty-one movable blades 4 are provided, which are moved to suitable positions so as to change the width of the strips into which the sheet 5 is to be slit.

Figure 4:
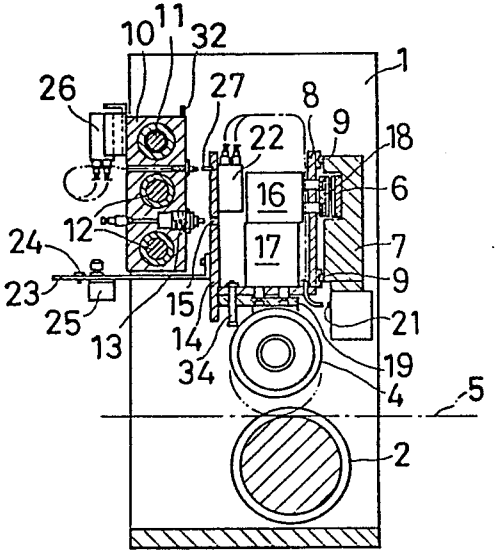
FIG. 4 is a sectional view taken along the line IV—IV in FIG. 3.

A long rack 6 is attached to a guide base 7 mounted on the frame 1 in parallel with the rotary shaft 3. Holders 8 are supported on guide rails 9 provided on the upper and lower portions of the guide base 7 and are movable back and forth laterally. A carrier 10 is adapted to be moved back and forth by a rotatable ball screw mechanism 11 which includes a longitudinally extending threaded member disposed in parallel with the rack 6. The carrier 1O is guided by guide rods 12, 12 as it moves. The carrier 10 is provided with a locking cylinder 13. When this locking cylinder 13 is advanced from the carrier 10 to enter a locking bore 15 in a cover 14 for one particular holder 8, the carrier 10 and the holder 8 becomes connected to each other so that the holder 8 can be moved back and forth along the rack 6 in accordance with the back and forth movement of the carrier 10. The number of the holders 8 provided in this embodiment corresponds to the number of the movable blades 4. Each holder 8 is provided with two twin rod cylinders 16, 17 as shown in FIG. 4, so that a positioning rack 18 for meshing with the rack 6 and a movable member 19 for holding a movable blade 4 in place may be operated to project and withdraw. A support shaft 20 is provided for rotatably supporting the movable blade 4 on the movable member 19. A plurality of light-emitting elements 21 are disposed along the guide base 7 at the same intervals as the stationary blades 2. Light-receiving members 22 are provided in the holders 8 and can be fiber sensors. Each light-receiving element 22 is adapted to receive a signal from one of the light-emitting elements 21 so as to control not only the projecting and withdrawing operation of the relative twin rod cylinder 17 but also the lighting of a light-emitting element 24 on a manual operating handle 23 provided on the outer side of the cover 14 for each holder 8. A switch 25 is provided for manually controlling the projecting and withdrawing operation of the twin rod cylinder 16. A light-receiving member 26 made of a fiber sensor is provided on the carrier 10, and can sense the position of a lock pin 27 provided on the cover 14 for each holder 8 and control the movement of the carrier 10.

Figure 5:
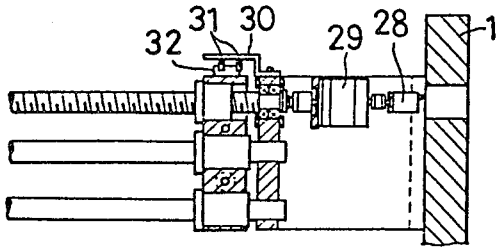
FIG. 5 is a sectional view taken along the line V—V in FIG. 2.
Figure 5:
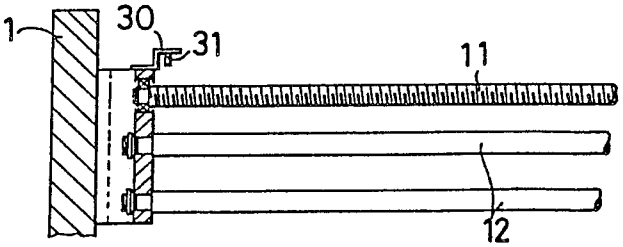

As shown in FIG. 5, the threaded member of the ball screw mechanism 11 used to control the movement of the carrier 10 is connected to a steping motor 29 to which a rotary encoder 28 is connected. The ball screw mechanism 11 is provided at the side portions of both end sections thereof with photosensors 31, 31 via brackets 30, 30. When the carrier 10 has reached the end of its range of movement and a detecting plate 32 in the carrier 10 is thus sensed by the photosensor 31, the rotation of the threaded member of the ball screw mechanism 11 is discontinued to cause the carrier 10 to stop.

The guide base 7 is inserted through the frame 1. When a lockup cylinder 33 attached to the frame 1 is operated, the guide base 7 and all the holders secured to the base 7 are pressed, so that the side surfaces of the stationary blades 2 and the movable blades 4 are pressed against each other.

The lock cylinder 13, the twin rod cylinders 16, 17, the light-emitting elements 21, the light-receiving members 22, 26 and the stepping motor 29 are connected to a control unit (not shown) and controlled by electric signals. A stopper pin 34 is provided for controlling the movement of each movable member 19.

The operation of this embodiment will now be described. When the holders 8 are in predetermined positions with the positioning racks 18 meshed with the rack 6 and with the movable blades 4 slidably contacting the stationary blades 2, the rotary shaft 3 is rotated so that the long-sized sheet 5 passing through between the stationary blades 2 and the movable blades 4 is slit into strips having a width corresponding to a present pitch for the adjacent movable blades 4.

For changing the width of the strips into which the sheet 5 is to be slit, the lockup cylinder 33 is moved back first to release the stationary blades 2 and the movable blades 4 from their contacting each other under pressure. The twin rod cylinder 17 in the holders 8 to be moved are withdrawn to separate the movable members 19 and the movable blades 4 from the stationary blades 2. The ball screw mechanism 11 is rotated to move the carrier 10 to the particular holder 8 desired to be shifted, and then the lock cylinder 13 in the carrier 10 is moved into the locking bore 15 in this holder 8 for engagement of the carrier 10 with the holder 8. The positioning rack 18 meshed with the rack 6 is then withdrawn by a backward movement of the twin rod cylinder 16 to disengage the positioning rack 18 from the rack 6. When the carrier 10 is then moved to a predetermined position, the holder 8 engaged therewith is also moved at once. When the holder 8 has reached a predetermined position, the positioning rack 18 is projected from the holder by cylinder 16 and meshed with the rack 6 at the new position. The lock cylinder 13 is then moved back to disengage the holder 8 and the carrier 10 from each other. The movable member 19 is then lowered by the projecting operation of the twin cylinder 17, and the movable blade 4 and the stationary blade 2 are brought into sliding contact with each other by operating the lockup cylinder 33, thereby completing again the preparation for carrying out the slitting of a sheet 5.

When it is necessary that a plurality of movable blades 4 be shifted, the holders 8 therefor are moved in order in the foregoing manner by the carrier 10 and then fixed at predetermined positions.

For manually shifting a particular holder 8, the lockup cylinder 33 is released and the switch 25 of the manual operating handle 23 is depressed while the movable blade 4 is in a withdrawn state, so as to move the twin rod cylinder 16 back, whereby the positioning rack 18 is withdrawn. Thereafter, the manual shifting of the holder 8 is carried out. The light-emitting element 24 only on the operating handle 23 that is relative to the movable blade 4 being actually used is lit, and the light-emitting elements 24 on those operating handles 23 which are relative to the movable blades 4 not being in actual use are not lit. Therefore, the condition of use of the movable blades 4 can be visually observed.

If, of the light-emitting elements 21 disposed in a row along the guide base 7, one opposed to the position to which the movable blade 4 is to be shifted is allowed to remain lit, the light-receiving member 22 on the holder 8 senses the light when the carrier 10 has reached that position, so that the stop operation of the carrier 10 and the engagement operation of the positioning rack 18 can be made automatically.

As described above, the slitting apparatus according to the present invention includes a stationary long rack extending in parallel with a rotary shaft of stationary blades, a carrier adapted to be moved back and forth along the rack, and holders adapted to be moved by the carrier, the holders having positioning racks and movable members holding movable blades so provided thereon as to be able to project outward and withdraw inward. Therefore, each holder can be positioned accurately by engagement of its positioning rack with the stationary long rack and remain so free of positional deviation in the lengthwise direction of the stationary rack. In addition, this increases the ability of the holders to withstand a lateral load.

Since each holder only contains therein the cylinders for operating the positioning rack and the movable member, the holder can be constructed thin and small-sized and the pitch of the movable blades can be reduced. When the positioning rack and the movable member are moved back, the holder can be shifted manually as well with ease, and the movable blade can be positioned speedily.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A slitting apparatus comprising a frame; a rotary shaft mounted on said frame; a plurality of laterally stationary circular blades secured to said rotary shaft; a plurality of laterally movable circular blades movable in the direction along which the stationary blades are disposed and rotatable in slidable contact with said stationary blades so that a sheet passing through between said stationary blades and said movable blades is slit therewith into plural strips each having a width being adjusted by moving said movable blades; a stationary rack extending in parallel with said rotary shaft; a carrier movable back and forth along said rack; means for moving said carrier; and holders detachably engagable with said carrier and moved along said rack by said carrier, each of said holders having a positioning rack adapted to project therefrom for meshing with said stationary rack and withdraw thereinto and a movable member for moving one of said movable blades to and withdraw the same from a position in which said movable blade slidably contacts said stationary blades.

2. An apparatus according to claim 1, wherein a first cylinder means is provided in said carrier for the detachable engagement of said carrier with said holders by the reciprocating movement, and second means are provided in each of said holders cylinders for the projection and withdrawing movements of said positioning rack and said movable member.

3. An apparatus according to claim 1, wherein a plurality of light-emitting elements are provided in a line along said stationary rack, light-receiving members for receiving the light from said light-emitting elements are provided on said holders and said carrier, and the projecting and withdrawing operations of said holders and the moved positions of said holders are controlled and confirmed by said light-receiving members provided respectively on the holders and the carrier.

* * * * *